US006077652A

United States Patent [19]

Hosoi

[11] Patent Number: 6,077,652

[45] Date of Patent: Jun. 20, 2000

[54] PHOTOGRAPHIC DEVELOPER AND METHOD FOR DEVELOPING SILVER HALIDE PHOTOGRAPHIC LIGHT SENSITIVE MATERIAL BY USE THEREOF

[75] Inventor: Yuji Hosoi, Hino, Japan

[73] Assignee: Konica Corporation, Tokyo, Japan

[21] Appl. No.: 09/064,607

[22] Filed: Apr. 23, 1998

[30] Foreign Application Priority Data

Apr. 24, 1997 [JP] Japan ..... 9-121701

[51] Int. Cl.[7] ..... G03C 5/305

[52] U.S. Cl. ..... 430/490; 430/480; 430/483; 430/486

[58] Field of Search ..... 430/480, 483, 430/486, 490

[56] References Cited

U.S. PATENT DOCUMENTS

| | | | |
|---|---|---|---|
| 2,193,015 | 3/1940 | Weissberger | 430/470 |
| 2,592,364 | 4/1952 | Weissberger et al. | 430/470 |
| 3,505,068 | 4/1970 | Beckett et al. | 430/138 |
| 3,574,628 | 4/1971 | Jones | 430/567 |
| 3,655,394 | 4/1972 | Illingsworth | 430/567 |
| 4,010,034 | 3/1977 | Suga et al. | 430/398 |
| 4,126,459 | 11/1978 | Greenwald | 430/234 |
| 4,346,065 | 8/1982 | Maurer et al. | 423/305 |
| 4,390,617 | 6/1983 | Okaniwa et al. | 430/350 |
| 4,414,310 | 11/1983 | Daubendiek et al. | 430/567 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,444,877 | 4/1984 | Koitabashi et al. | 430/567 |
| 5,498,511 | 3/1996 | Yamashita et al. | 430/496 |

FOREIGN PATENT DOCUMENTS

| | | |
|---|---|---|
| 0315952A1 | 5/1989 | European Pat. Off. . |
| 0531582A1 | 3/1993 | European Pat. Off. . |
| 19501053A1 | 7/1996 | Germany . |
| 49-020983 | 5/1974 | Japan . |

*Primary Examiner*—Hoa Van Le
*Attorney, Agent, or Firm*—Finnegan, Henderson, Farabow, Garrett & Dunner, L.L.P.

[57] ABSTRACT

A photographic developer which is improved in storage stability is disclosed, comprising a developing agent represented by formula (1) and a compound represented by formula (2).

formula (1)

wherein $R_1$ are $R_2$ and $R_3$ independently are a hydrogen atom or an alkaline metal atom;

formula (2)

$M_nHAO_3$ wherein M is a univalent or bivalent atom and A is an atom of the 5B group of the periodic table, except for N.

5 Claims, No Drawings

PHOTOGRAPHIC DEVELOPER AND METHOD FOR DEVELOPING SILVER HALIDE PHOTOGRAPHIC LIGHT SENSITIVE MATERIAL BY USE THEREOF

FIELD OF THE INVENTION

The present invention relates to a method for processing a silver halide photographic light sensitive material (hereinafter, referred to as photographic material) and a photographic developer, and in particular a processing method which is stable even when processed at a low replenishing rate of 100 ml/m$^2$ or less and a developer with improved storage stability.

BACKGROUND OF THE INVENTION

Currently, an increasing concerns in environmental protection of the earth has been taken, open-sea disposal of photographic processing effluent has been prohibited, and reduction of the amounts of processing agents used in the field of medical diagnosis is required.

In one aspect of the art, reduction of the replenishing rate of processing solutions is desired. To reduce the replenishing rate, the concentration of components of the developing solution is increased and thereby the amount of the components to be supplied to the photographic material is balanced. However, when the replenishing rate is decreased, the time of the developing solution remaining in the developing tank is extended and the developing solution is subject to aerial oxidation, producing a problem of the activity of the developing solution being lowered.

SUMMARY OF THE INVENTION

It is an object of the present invention to provided a method for processing a photographic material in which no lowering of the activity of a developing solution due to aerial oxidation occurs even when processed at a low replenishing rate and a developer to be used therein.

Employed in conventional developer solutions containing hydroquinone as a developing agent are a sulfite such as sodium sulfite, sodium bisulfite and potassium sulfite to prevent aerial oxidation of the developing agent. In a developer solution containing, as a developing agent, reductones, however, the sulfite does exhibit little antioxidizing effect, compared to a developer solution containing hydroquinone. It is known that preserving property of the reductone can be enhanced by increasing the hydrogen ion concentration of the developer solution. However, this action results in lowering of the activity of the developer solution and deterioration of developability, leading to insufficient image density and insufficient sensitivity.

Accordingly, the above object of the invention can be accomplished by the following constitution:

1. a method for processing a silver halide light sensitive photographic material, characterized in that the photographic material is developed in the presence of a compound represented by formula (1) and a compound represented by formula (2):

formula (1)

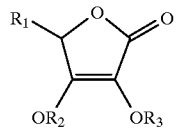

wherein $R_1$ are

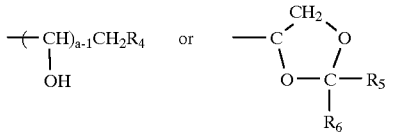

$R_2$ and $R_3$ independently are a hydrogen atom or an alkaline metal atom; $R_4$ is a hydrogen atom or hydroxy group; $R_5$ and $R_6$ independently are a hydrogen atom, halogen atom, an alkyl group, alkenyl group, aryl group, alkoxy group, aryloxy group, alkylthio group, arylthio group, acyl group, oxycarbonyl group, carbamoyl group, carboxy group including its salt, sulfo group including its salt, or heterocyclic group, $R_5$ and $R_6$ may combine with each other to form a ring, and these groups or ring may be substituted; a is an integer of 1 to 4;

$M_nHAO_3$ formula (2)

wherein M is a univalent or bivalent atom, when M is univalent, n is 2 and when M is bivalent, n is 1, and A is an atom of the 5B group of the periodic table, except for N;

2. a method for processing a silver halide light sensitive photographic material, characterized in that the photographic material is developed in the presence of a compound represented by formula (1) and a compound represented by formula (2) and further in the presence of a compound represented by formula (3) or (4):

formula (3)

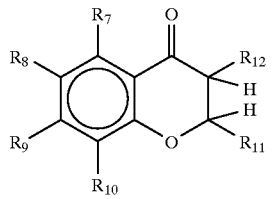

wherein $R_7$, $R_9$, $R_{11}$ and $R_{12}$ are independently a hydrogen atom, hydroxy group, carboxy group, alkyl group, aryl group, alkoxy group, aryoxy group, substituted alkyl group, substituted aryl group, substituted alkoxy group, substituted aryoxy group and a saccharide residue, provided that all of $R_7$, $R_9$, $R_{11}$ and $R_{12}$ are hydrogen atoms at the same time; $R_8$ and $R_{10}$ are independently a hydrogen atom, halogen atom, hydroxy group, carboxy group, alkyl group, aryl group, alkoxy group, aryloxy group, substituted alkyl group, substituted aryl group, substituted alkoxy group, substituted aryoxy group and a saccharide residue;

formula (4)

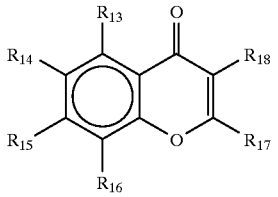

wherein $R_{13}$, $R_{15}$, $R_{17}$ and $R_{18}$ are independently a hydrogen atom, hydroxy group, carboxy group, alkyl group, aryl group, alkoxy group, aryloxy group, substituted alkyl group, substituted aryl group, substituted alkoxy group, substituted aryoxy group and a saccharide residue, provided that all of $R_{13}$, $R_{15}$, $R_{17}$ and $R_{18}$ are hydrogen atoms at the same time; $R_{14}$ and $R_{16}$ are independently a hydrogen atom, halogen atom, hydroxy group, carboxy group, alkyl group, aryl group, alkoxy group, aryloxy group, substituted alkyl group, substituted aryl group, substituted alkoxy group, substituted aryoxy group and a saccharide residue;

3. a method for processing a silver halide light sensitive photographic material described in above 1 or 2, characterized in that an average residence time of a developer solution in a developing tank of an automatic processor is not less than 10 days and not more than 30 days;
4. a developer, characterized in that the developer contains a compound represented by formula (1)described above and a compound represented by formula (2) described above;
5. a developer, characterized in that the developer contains a compound represented by formula (1), a compound represented by formula (2), and a compound represented by formula (3) or (4);
6. the developer described in above 4 or 5, characterized in that the developer is an aqueous solution; and
7. the developer described in above 4 or 5, characterized in that the developer is a solid processing composition.

DETAILED DESCRIPTION OF THE INVENTION

According to the invention, as a result of studies of antioxidants for the developer solution containing the compound represented by formula (1) as a developing agent, the compound represented by formula (2) was found to exhibit superior effects. It was further found that concurrent use of a compound represented by formula (3) or (4) led to further enhance preserving property.

According to the invention, the photographic material is developed in the presence of the compound represented by formula (1) and the compound represented by formula (2). The compound represented by formula (1) includes an enediol type, enaminol type, enediamine type, thiolenol type and enaminethiol type.

Formula (1)

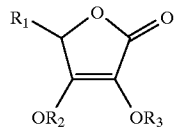

In the formula, $R_1$ are

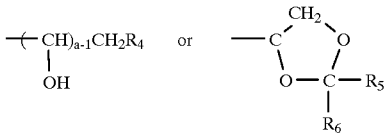

$R_2$ and $R_3$ independently are a hydrogen atom or an alkaline metal atom; $R_4$ is a hydrogen atom or hydroxy group; $R_5$ and $R_6$ independently are a hydrogen atom, halogen atom, an alkyl group, alkenyl group, aryl group, alkoxy group, aryloxy group, alkylthio group, arylthio group, acyl group, oxycarbonyl group, carbamoyl group, carboxy group including its salt, sulfo group including its salt, or heterocyclic group, $R_5$ and $R_6$ may combine with each other to form a ring comprised of a carbon atom, nitrogen atom, oxygen atom, or sulfur atom; and a is an integer of 1 to 4. These groups (or ring) may be substituted, and examples of a substituent include an alkyl group, alkenyl group, aryl group, halogen atom, cyano group, nitro group, hydroxy group, alkoxy group, aryloxy group, alkylthio group, arylthio group, acyloxy group, amino group, alkylamino group, carbonamido group, sulfonamido group, ureido group, acyl group, oxycarbonyl group, carbamoyl group, sulfonyl group, sulfamoyl group, carboxy group including its salt, sulfo group including its salt, hydroxyamino, or heterocyclic group.

Of the substituent represented by $R_5$ and $R_6$ are preferably a hydrogen atom, substituted or unsubstituted alkyl, alkenyl and aryl groups, more preferably, a hydrogen atom or substituted or unsubstituted alkyl group, and still more preferably a substituted or unsubstituted alkyl group. Examples of the substituent include an alkyl group, alkenyl group, aryl group, halogen atom, hydroxy group, alkoxy group, carboxy group (including its salt), sulfo group (including its salt) and hydroxyamino group.

The compound represented by formula (1) can be obtained according to the methods conventionally known. The compound is contained in a developing solution, preferably in an amount of 20 to 80 g/l, and more preferably 30 to 70 g/l.

$M_nHAO_3$ Formula (2)

In the formula, M is a univalent or bivalent atom, including an alkaline metal atom (e.g. Li, Na, K) or an alkaline earth metal atom (e.g. Ca, Mg); when M is univalent, n is 2 and when M is bivalent, n is 1; and A is an atom of the 5B group of the periodic table, except for N. Thus, A is an atom selected from the group consisting of elements of the 5B group of the periodic table, except for N. Examples thereof include P, As, Sb and Bi atoms. Of these, phosphor atom is preferable. Exclusion of the nitrogen atom is based on the fact that a nitrogen containing compound was experimentally low in its effect. It is contemplated that the nitrogen atom forms a stable pπ—pπ double bond, and on the other hand, the energy level of a 3d orbit of phosphor or higher atoms is lower and the 3d orbit plays a part in reaction. The compound represented by formula (2) can be synthesized according to the method known in the art. The compound is contained in a developing solution preferably in an amount of from 0.01 mol/l to 1 mol/l, and more preferably 0.05 mol/l to 0.5 mol/l.

In the processing method according to the invention, when development is performed further in the concurrent presence of a compound represented by formula (3) or (4), preservability is further enhanced.

Formula (3)

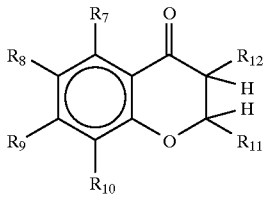

In the formula, $R_7$, $R_9$, $R_{11}$ and $R_{12}$ are independently a hydrogen atom, hydroxy group, carboxy group, alkyl group, aryl group, alkoxy group, aryoxy group, substituted alkyl group, substituted aryl group, substituted alkoxy group, substituted aryoxy group and a saccharide residue, provided that all of $R_7$, $R_9$, $R_{11}$ and $R_{12}$ are hydrogen atoms at the same time. Examples of the saccharide residue include a monosaccharide group and an oligosaccharide group including one in which 2 or 4 monosaccharides are linked through glycicide bonding. Of these, hydroxy, methoxy, phenyloxy, hydroxy-substituted phenyl and a saccharide residue are preferred, and hydroxy and hydroxy-substituted phenyl are more preferred; $R_8$ and $R_{10}$ are independently a hydrogen atom, halogen atom, hydroxy group, carboxy group, alkyl group, aryl group, alkoxy group, aryloxy group, substituted alkyl group, substituted aryl group, substituted alkoxy group, substituted aryoxy group and a saccharide residue, and of these, a hydrogen atom and hydroxy are preferred.

Formula (4)

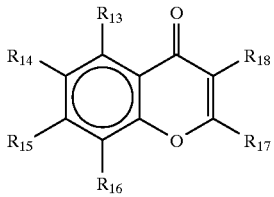

In the formula, $R_{13}$, $R_{15}$, $R_{17}$ and $R_{18}$ are independently a hydrogen atom, a halogen atom hydroxy group, carboxy group, alkyl group, aryl group, alkoxy group, aryloxy group, substituted alkyl group, substituted aryl group, substituted alkoxy group, substituted aryoxy group and a saccharide residue, provided that all of $R_{13}$, $R_{15}$, $R_{17}$ and $R_{18}$ are hydrogen atoms at the same time, and of these, hydroxy, methoxy, phenyloxy, hydroxy-substituted phenyl and a saccharide residue are preferred, and hydroxy and hydroxy-substituted phenyl are more preferred; $R_{14}$ and $R_{16}$ are independently a hydrogen atom, halogen atom, hydroxy group, carboxy group, alkyl group, aryl group, alkoxy group, aryloxy group, substituted alkyl group, substituted aryl group, substituted alkoxy group, substituted aryoxy group and a saccharide residue, and of these, a hydrogen atom or hydroxy is preferred. The compound represented by formula (3) or (4) can be obtained according to the method known in the art. The compound is contained in a developing solution preferably in an amount of 0.001 mol/l to 0.1 mol/l, and more preferably, 0.01 mol/l to 0.07 mol/l.

In the invention, when an average residence time of a developing solution in a developer tank of an automatic processor is held within not less than 10 days and not more than 30 days, the stable sensitivity is preferably maintained. Herein, when processing the photographic material by means of an automatic processor, the average residence time is defined as follows:

$$\text{Average Residence Time}=1/(1-1/10^{sr/2.303V})$$

where V is the volume of a developing solution contained in a developer tank of a processor; S is a processing amount per day, expressed in $m^2$/day; R is a developer replenishing rate, expressed in $1/m^2$.

Exemplary examples of the compound represented by formula (1) are shown below, but the invention is not limited to these examples.

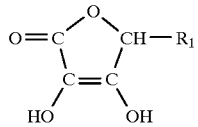

1-1

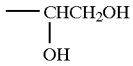

1-2

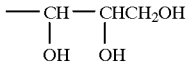

1-3

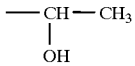

1-4

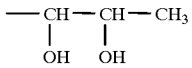

1-5

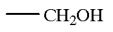

1-6

1-7

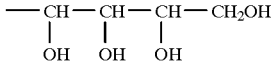

1-8

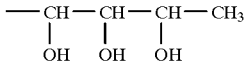

The compound represented by the following formula is further described:

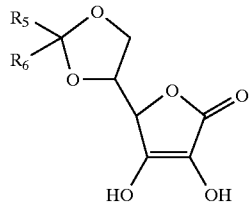

wherein $R_5$ and $R_6$, which may be the same with or different from each other, are independently a hydrogen atom or a substituent, as afore-mentioned.

Exemplary examples thereof are shown below.
1-9
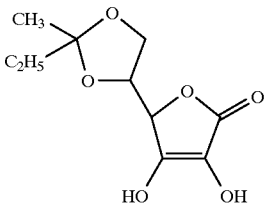
1-10
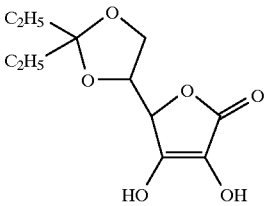
1-11
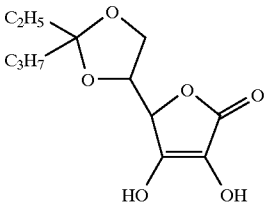
1-12
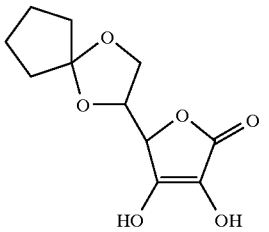
1-13
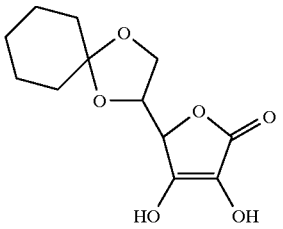
1-14
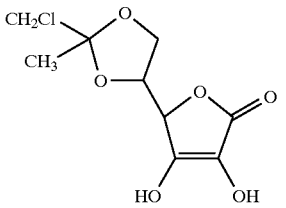
-continued
1-15
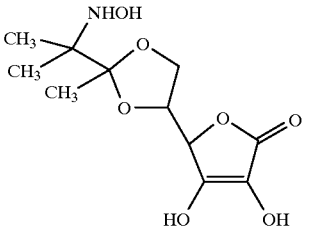
1-16
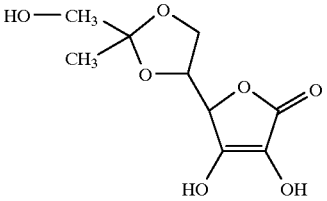
1-17
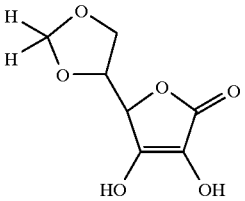
1-18
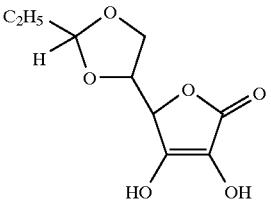
1-19
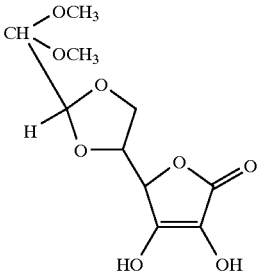
1-20
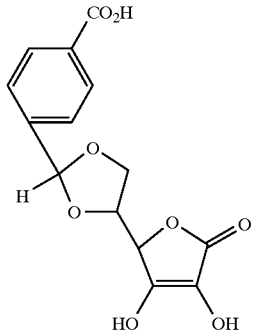

The compound represented by formula (1) is represented in the form of an enol, and a compound in an isomeric keto form is essentially an identical one, therefore, an isomerized compound which is formed through prototropy, falls within the scope of the invention.

The compound used in the invention can be employed in the form of an alkaline metal salt, such as lithium salt, sodium salt, and potassium salt. In the invention, the most preferable compounds are ascorbic acid, erythorbic acid and their derivatives.

Examples of the compound represented by formula (2) are shown below, but is not limited to these.

2-1 $K_2HPO_3$ 2-2 $Na_2HPO_3$ 2-3 $MgHPO_3$ 2-4 $K_2HSbO_3$ 2-5 $Na_2HSbO3$ 2-6 $MgHSbO_3$ 2-7 $K_2HBiO_3$ 2-8 $Na_2BiO_3$ 2-9 $MgHBiO_3$

Exemplary examples of the compounds represented by formulas (3) and (4) are shown below, but the invention is not limited to these examples.

3-1

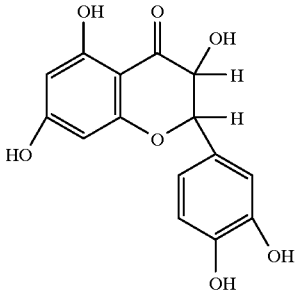

3-2

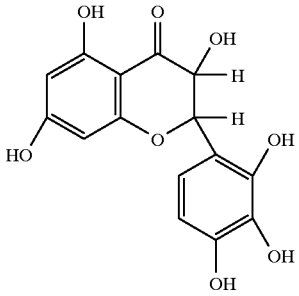

3-3

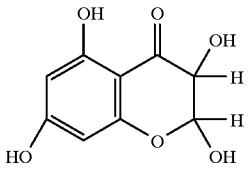

-continued 3-4

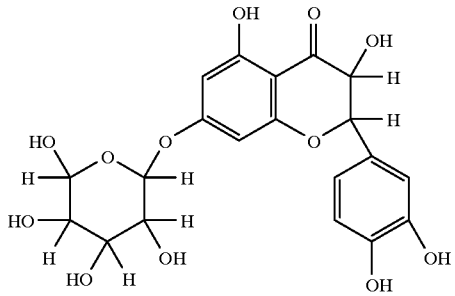

3-5

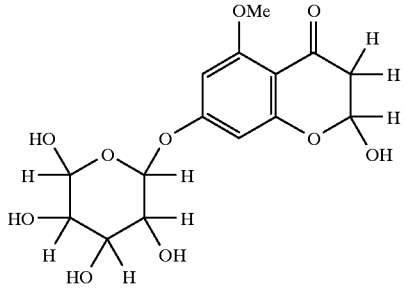

3-6

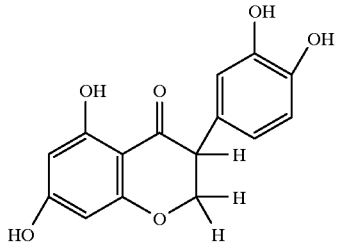

3-7

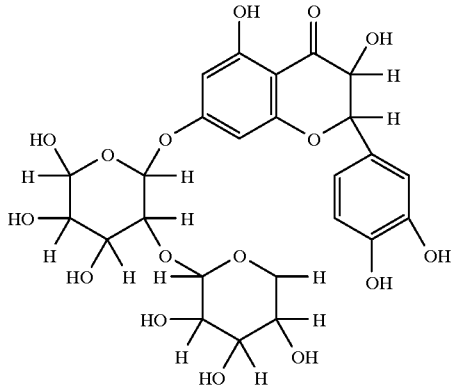

-continued
3-8
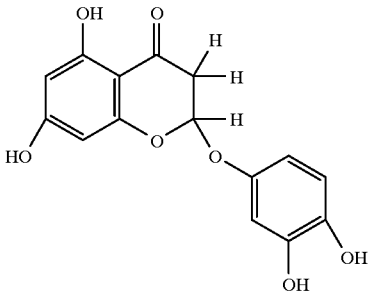
3-9
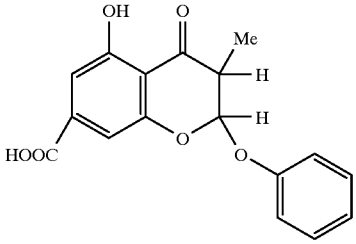
3-10
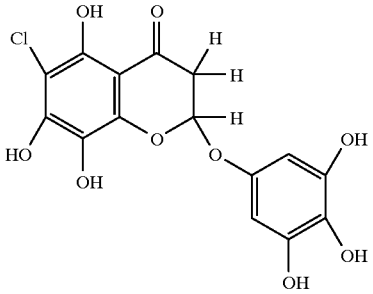
3-11
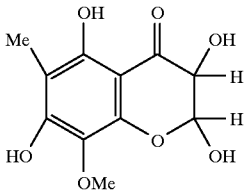
3-12
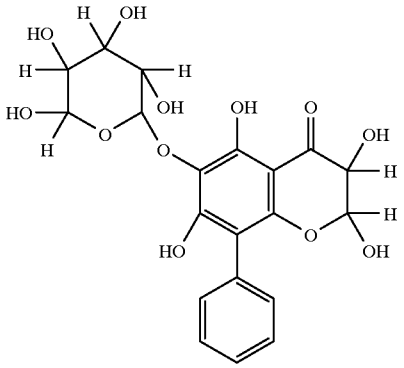
-continued
4-1
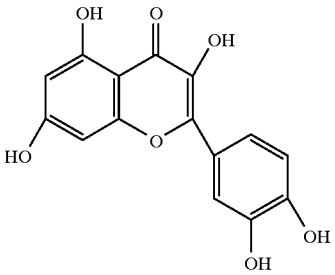
4-2
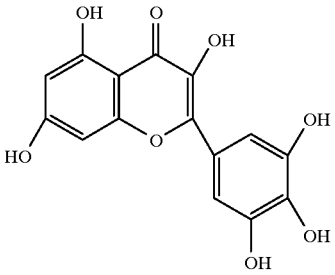
4-3
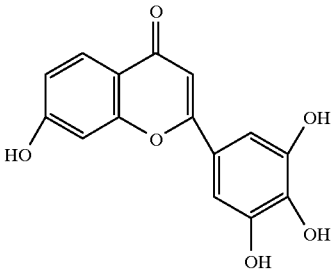
4-4
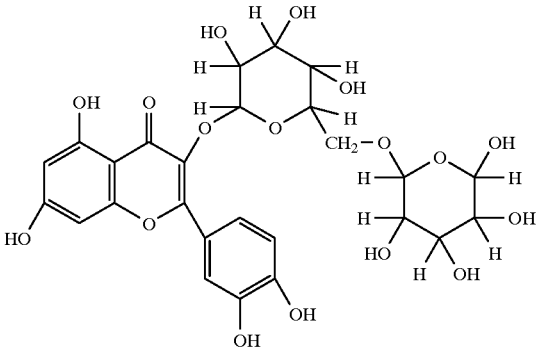
4-5
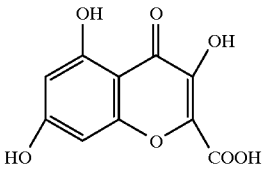

-continued 4-6

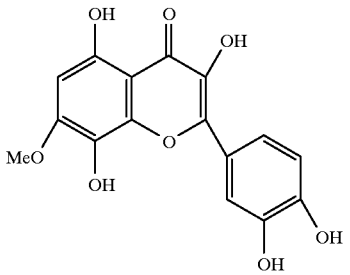

4-7

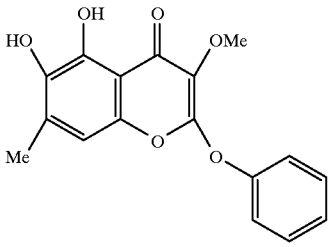

4-8

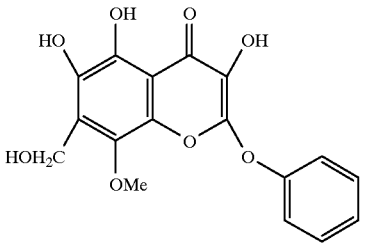

4-9

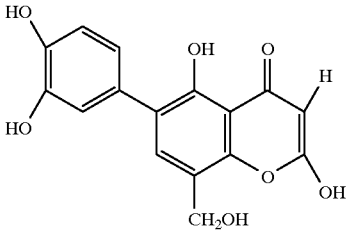

4-10

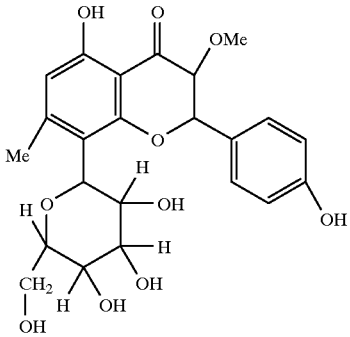

Of the foregoing examples is preferred a compound of 3-1.

The developer used in the invention contains the compound represented by formula (1) and the compound represented by formula (2). The developer may be in the form of an aqueous solution or a solid developing composition. The developer preferably further contains the compound represented by formula (3) or (4) to thereby enhance preserving property. The developer may contain each of these compounds singly or in combination therewith.

The developer may contain a developing agent other than the compound represented by formula (1). Examples thereof include substituted dihydroxybenzenes (e.g. chlorohydroquinone, bromohydroquinone, dichlorohydroquinone, i-propylhydroquinone, methylhydroquinone, 2,3-dichlorohydroquinone, methoxyhydroquinone, 2,5-dimethylhydroquinone, potassium hydroquinonemonosulfonate, sodium hydroquinonemonosulfonate); 3-pyrazolidones (e.g. 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, 1-phenyl-4-methyl-4-hydroxy-3-pyrazolidone, 1-phenyl-4,4-dihydroxymethyl-3-pyrazolidone, 1-p-tolyl-3-pyrazolidone, 1-phenyl-2-acetyl-4,4-dimethyl-3-pyrazolidone, 1-(2-benzothiazole)-3-pyrazolidone, 3-acetoxy-1-phenyl-3-pyrazolidone); aminophenols (e.g. o-aminophenol, p-aminophenol, N-methyl-o-aminophenol, N-methyl-p-aminophenol, 2,4-diaminophenol); 1-allyl-3-aminopyrazolines {e.g. 1-(p-hydroxyphenyl)-3-aminopyrazoline, 1-(p-methylaminophenyl)-3-aminopyrazoline, 1-(p-amino-m-methylphenyl)-3-aminopyrazoline}; pyrazolones (e.g. 4-aminopyrazolone) and a mixture thereof.

The developing solution may optionally contain a buffering agent (e.g. a carbonate, borate, and alkanolamine), an alkaline agent (e.g. a carbonate), a dissolution aid (e.g. polyethylene glycols and their esters), a pH-adjusting agent (e.g. organic acids such as citric acid and tartaric acid), a sensitizer (e.g. a quaternary ammonium), a development-accelerating agent, a hardening agent (e.g. dialdehydes such as glutar aldehyde) or a surfactant. There may be added a fog inhibitor, such as azole type organic fog inhibitor (including an indazole type, imidazole type, benzoimidazole type, triazole type benzotriazole type, tetrazole type, thiadiazole type). Compounds described in JP-A 56-24347 may be employed as an anti-silver-staining agent.

The pH of the developing solution used in the invention is preferably 9 to 12 and more preferably 9.5 to 10.5.

The developer may further contain an amine compound such as an alkanolamine described in JP-A 56-106244 and compounds described in L. F. A. Mason "Photographic Processing Chemistry" published by Focal Press (1966) pages 22–229; U.S. Pat. Nos. 2,193,015 and 2,592,364; and JP-A 48-64933.

A fixer used in the invention contains preferably a thiosulfate, as a fixing agent. The thiosulfate is conventionally employed in the form of its lithium, sodium, potassium or ammonium salt; of these are preferably employed sodium thiosulfate or ammonium thiosulfate, and an ammonium salt is preferred in terms of the fixing speed and a sodium salt is more preferred in terms of stability.

The concentration of the thiosulfate is preferably 0.1 to 5 mol/l, more preferably 0.5 to 2 mol/l and still more preferably 0.7 to 1.8 mol/l. An iodide or a thiocyanate can also employed as a fixing agent. The fixer may contain a sulfite. The concentration of the sulfite is 0.2 mol/l or less, when the thiosulfate and sulfite are dissolved in an aqueous solvent. The sulfite is employed in the form of a lithium, sodium, potassium or ammonium salt, which is dissolved with a solid thiosulfate. The fixer may contain an aqueous soluble chromium salt or an aqueous soluble aluminum salt. Examples of the aqueous soluble chromium include chromium alum, and examples of the aqueous soluble aluminum salt include aluminum sulfate, potassium aluminum chloride and aluminum chloride. The chromium salt or aluminum salt is contained preferably in an amount of 0.2 to 3.0 g, and more preferably 1.2 to 2.5 g per liter of a fixing solution.

The fixer may further contain acetic acid, citric acid, tartaric acid, malic acid, succinic acid, phenylacetic acid and their optical isomers. Lithium, sodium, potassium and ammonium salts of these acids are preferably employed, including potassium citrate, lithium citrate, sodium citrate, ammonium citrate, lithium hydrogentartarate, potassium hydrogentartarate, potassium tartarate, sodium hydrogentartarate, sodium tartarate, ammonium hydrogentartarate, ammonium potassium tartarate, potassium sodium tartarate, sodium malate, ammonium malate, sodium succinate and ammonium succinate. Of these are preferred acetic acid, citric acid, isocitric acid, malic acid, phenylacetic acid and their salts. These acids or their salts are preferably contained in an amount of 0.2 to 0.6 mol/l. Inorganic acids such as sulfuric acid hydrochloric acid, nitric acid and boric acid, and organic acids such as formic acid, propionic acid, oxalic acid and malic acid may also be employed, and boric acid, amino(poly)carboxylic acids and their salts are preferably employed. Particularly preferred aminocarboxylic acids include β-alanine and piperidinecarboxylic acid. These acids are contained preferably in an amount of 0.5 to 40 g/l. A chelating agent may be contained, including aminopolycarboxylic acids such as nitrilotriacetic acid and ethylenediaminetetraacetic acid and their salts. There may be contained a surfactant such as an anionic surfactant including a sulfate ester and sulfonate, a nonionic surfactant including a polyethylene glycol type and ester type and an amphoteric surfactant described in JP-A 57-6840; an wetting agent such as an alkanol amine and alkylene glycol; and a fix-accelerating agent such as thioureas described in JP-A 45-35754 and JP-B 58-122535 and 58-122536, an alcohol which has a triple bond within the molecule, a thioether described in U.S. Pat. No. 4,126,459. The pH of a fixing solution is conventionally 3.8 or higher, and preferably 4.2 to 5.5.

The developer or fixer used in the invention is provided preferably in the form of a concentrated solution or in a solid form.

The processing composition can be solidified in such a manner that the processing composition, which is in the form of a concentrated solution, fine powder or granules, is mixed with a water soluble bonding agent and then the mixture is molded, or a water soluble bonding agent is sprayed on the surface of a temporarily-molded processing composition to form a covering layer, as described in JP-A 4-29136, 4-85533, 4-85534, 4-85535, 4-85536 and 4-172341.

Further, the solid composition is preferably in the form of a tablet. A preferred tablet-making process is to form a tablet by compression-molding after granulating a powdery processing composition. As compared to a solid composition prepared simply by mixing the processing composition to form a table, there is an advantage that improvements in solubility and storage stability are achieved and as a result, photographic performance is stabilized. As for the granulation process which is carried out prior to the tablet-making process, any conventionally known method can be employed, such as fluidized-bed granulation process, extrusion granulation process, compression granulation process, crush granulation process, fluid layer granulation process, and spray-dry granulation process. It is preferred that the average grain size of the granules is 100 to 800 μm and more preferably 200 to 750 μm. In particular, 60% or more of the granules are to be within a deviation of ±100 to 150 μm. When the grain size is smaller, it tends to cause localization of the mixed elements and therefore, is undesirable. As a hydraulic press machine, any conventional compression molding machine, such as a single-engine compression molding machine, rotary-type compression machine, briquetting machine, etc. may be employed to form the tablets. Compression-molded (compression-tableted) solid processing composition may take any form and is preferably in a cylindrical form from the point of productivity and handleability, and from problems of powder dust in cases when used in end user. In the above process, it is further preferred to granulate separately each component, such as an alkali agent, reducing agent and preservative.

The solid processing composition, in the form of a tablet, can be prepared according to any of several methods, as described in JP-A 51-61837, 54-155038, 52-88025, and British Patent 1,213,808. The granular processing composition can also be prepared according to methods described in JP-A 2-109042, 2-109043, 3-39735 and 3-39739. The powdery processing composition can be prepared according to methods described in JP-A 54-133332, British Patent 725,892 and 729,862 and German Patent 3,733,861.

The bulk density of the above-described solid processing composition is preferably 1.0 to 2.5 g/cm$^3$ in terms of solubility and for desired effects of the invention. When at least 1.0 g/cm$^3$, it is advantageous for strength of the solid composition; and when being not more than 2.5 g/cm$^3$, it is advantageous for solubility. In the case of the developing or fixing composition in the form of granules or powder, its bulk density is preferably 0.40 to 0.95 g/cm$^3$.

As for the means for supplying the solid processing composition to the processing tank, and in the case where the solid processing composition is in the tablet form, for example, there are such well-known means as described in Japanese Utility Model OPI Publication Nos. 63-137783, 63-97522 and 1-85732, wherein, in short, any of several well-known means may be used, provided that at least a function for supplying a tableted composition to a processing tank can be performed. And, in the case where the solid processing composition is of the granulated or powdered form, there are such a well-known means such as the gravity dropping systems described in JP-A. 62-81964, 63-84151 and 1-292375, and screw systems described in JP-A 63-105159 and 63-84151. However, the invention shall not be limited to the above-cited well-known means.

Among these, however, a preferable means for supplying the solid processing composition to a processing tank is such a means, for example, that a prescribed amount of a solid processing composition is weighed out in advance and is then separately packed and the package thereof is opened and the composition is then taken out of the package so as to meet the required quantity of light-sensitive materials to be processed. To be more concrete, any prescribed amount of a solid processing chemical and, preferably, any amount for a single replenishment is sandwiched between at least two packing materials constituting a package. When peeling the package apart or opening a part of the package, the solid processing composition can be readily removed. The solid processing composition is then readily supplied to a processing tank, having a filtration means by dropping the composition into it. The prescribed amount of the solid processing composition are each separately packed in a tightly sealed package so as to prevent exposure to the open air and to prevent contamination of any adjacent solid processing composition. Therefore, the moisture proofing is ensured until the packages are opened.

A preferred embodiment of the invention may be to have a constitution in which a package comprising at least two packing materials sandwiching a solid processing composition between them and which is brought into close contact with or adhered to the periphery of the solid processing chemical on each of the contacting surfaces of the two packing materials so as to be separable from each other, if desired. When the packing materials, sandwiching the solid processing, are pulled apart, the close contact or adhered surfaces are separated from each other, allowing the solid processing composition to be readily removed.

Still another embodiment of the invention may be to have the following constitution, in which a package comprising at least two packing materials sandwiching a solid processing composition between them so that at least one of the packing materials can be ready to open a seal by applying an external force. The expression, "to open a seal", stated herein means that a packing material which is notched and broken or torn off, as a part of the packing material remains. It may also be considered to open the seal in such a manner that a solid processing composition is forcibly extruded by applying a compression force th the side(s) of the unopened packaging material which is thereby readily opened, or that a solid processing composition can be readily removed by notching the packaging material using a sharp-edged member.

A supply-starting signal can be obtained by detecting information on the processing amount. Based on the supply-starting signal, a driving means for separation or opening a seal is operated. A supply-stopping signal can be obtained by detecting information on the completion of a specific amount of supply. Based on the obtained supply-stopping signal, a driving means for separation or opening a seal is so controlled as to be stopped in operation.

The above-mentioned solid processing composition supplying means has a means for controlling the addition of a specific amount of the solid processing composition. To be more concrete, in an automatic processor of the invention, these means are required to keep all component concentration(s) constant in each processing tank and to stabilize every photographic characteristic.

A solid processing composition of the invention may be added to any position inside a processing tank and, preferably, to a position connected with a section for processing a photographic material and for circulating a processing solution between the processing tank and the processing section. It is also preferable to have such a structure that a certain amount of processing solution can be circulated so that a dissolved component can be fed to the processing section. It is further preferable that a solid processing composition be added to a thermostatically controlled processing solution.

Generally in an automatic processor, the temperature of a processing solution loaded therein is controlled by an electric heater. As for a general method thereof, a heat exchanger section is provided to an auxiliary tank connected to a processing tank, while a heater is also provided thereto, and a pump is further arranged so as to circulate a given amount of the solution from the processing tank to the auxiliary tank, which tends to keep the temperature constant.

A filter is usually arranged for the purpose of removing a crystallized foreign substances contained in the processing solution or produced by crystallization.

It is allowed to connect a replenishing tank to a section connected to a processing section, such as the above-mentioned auxiliary tank.

All materials of the filters, filtration devices and so forth applicable to any ordinary automatic processors can also be used in the invention, and specific structures and materials shall not alter the effects of the invention.

In the invention, the circulation cycle of the processing solution circulated by a circulation means is to be within the range of, 0.5 to 2.0 times/minute, preferably 0.8 to 2.0 times/minute and more preferably 1.0 to 2.0 times/minute. The expression, "a circulation cycle", herein is related to the flow rate of the liquid to be circulated, and one circulation cycle herein means when the liquid amount corresponding to the total liquid amount contained in the processing tank is pumped out and back into the tank. The solid processing composition is added to the processing tank, separately from the replenishing water, which is supplied from the water storage tank.

The compounds represented by formula (1) through (4) may be contained in a solid developer composition. In this case, the content of the compound represented by formula (1) is preferably 15% to 50% by weight and more preferably 20% to 45% by weight, based on the solid developer composion. The content of the compound represented by formula (2) is preferably 0.06 to 6 mol/Kg and more preferably 0.3 to 3 mol/Kg, based on the solid developer composion. The content of the compound represented by formula (3) or (4) is preferably 0.006 to 0.6 mol/Kg and more preferably 0.06 to 0.45 mol/Kg, based on the solid developer composion.

Employed, as a binder, in the solid processing composition are saccharides (monosaccharides and polysaccharides in which plural monosaccharides are bound through a glucosido bond), as described in Japanese Patent Application No. 6-91987 (page 23–30), and those selected from dextrines and sugar alcohols are preferably employed, thereby leading to little variation in form after a long period of storage, reduced troubles occurred at the time of addition and improvements in handling convenience. Preferably employed, as a lubricant, in the solid processing composition are acylated aminoacids, as described in Japanese Patent Application No. 5-186254 (page 9–15), which tend to lead to stable preparation of the solid processing composition without adversely affecting its strength, less deterioration in solubility, improved storage stability and reduced dust production. Preferably employed in the solid processing composition are, as a coating agent, hydroxyamines, phenylcarboxylic acids, hydroxy- or carboxy-substituted alkyl (or alkenyl)carboxylic acids, sulfites, aqueous soluble polymers (e.g. a polyalkylene glycol, a methaacrylic acid betaine type polymer) and saccharides as described in Japanese Patent Application No. 6-70860 (page 14–33), thereby leading to reduced occurrence of fine powder, less deterioration in solubility, superior storage stability and the assured stable photographic performance.

Photographic materials used in the invention are not limitative. The photographic materials can be prepared by means known in the photographic art. Photographic emulsions used in the photographic material can be prepared according to the methods known in the art, as described in Research Disclosure (RD) 17643 (December 1978) page 22–23, Sect. I "Emulsion Preparation and Types"; RD 18716 (November 1979) page 648; T. H. James "The Theory of the Photographic Process" 4th ed., Macmillan Publishing Co. (1977) page 38–104; G. F. Duffin "Photographic Emulsion Chemistry", Focal Press Co. (1966), P. Glafkides "Chimie et physique photographique", Paul Montel (1967); and V. L. Zelikman et al. "Making and Coating Photographic Emulsion" Focal Press Co. (1964).

Preferred silver halide emulsions include an internally high iodide-containing, monodispersed grain emulsion described in JP-A 59-177535, 61-802237, 61-132943, 63-49751 and 2-85846. Silver bromochloride or silver chloride containing chloride of 50 mol % or more are also preferably employed. With regard to the crystal structure of silver halide is preferably employed a core/shell type monodisperse emulsion grains having two layer comprised of a high iodide core and low iodide shell, in which the iodide content of the high iodide portion is preferably 20 to 40 mol % and more preferably 20 to 30 mol %, as exemplified in J. Phot. Sci. 12, 242–251 (1963), JP-A 48-36890, 52-16364, 56-142329, 58-49938; British Patent 1,413,748 and 1,027,146; U.S. Pat. Nos. 3,574,628, 3,655,394, 3,505,068, and 4,444,877 and JP-A 60-14331. A silver halide emulsion preferably employed in the invention is comprised of tabular grains having an average aspect ratio of 1 or more. Advantages of the tabular grains concern improvements in spectral sensitization efficiency, image graininess and sharpness, as described in British Patent 2,112,157; U.S. Pat. Nos. 4,439,520, 4,433,048, 4,414,310 and 4,434,226; JP-A 58-113927, 58-127921, 63-138342, 63-284272 and 63-305343. The emulsion can be prepared according to the method described in the above references.

In these emulsions may be contained a cadmium salt, lead salt, zinc salt, thallium salt, iridium salt including its complex salt, rhodium salt including its complex salt, or a iron salt including its complex salt at the stage of grain formation or physical ripening. The emulsion may be subjected to washing to remove soluble salts, such as noodle washing or flocculation process. Preferred washing includes the method by use of a sulfo group-containing aromatic hydrocarbon type aldehyde resin described in JP-B 35-16086 and the method by use of a polymeric coagulating agent, G3 or G8 described in JP-A 63-158644. The silver halide emulsion can be chemically ripened by the use of gold sensitization, sulfur sensitization, reduction sensitization or chalcogen sensitization, singly or in combination thereof.

A variety of photographic adjuvants may be incorporated to the emulsion before, during, or after physical or chemical ripening. There may be incorporated a hydrazine compound, for example, a compound represented formula (5) described in Japanese Patent Application No. 5-134743, including a nucleation accelerating agent represented by formulas (7) and (8). A tetrazolium compound may be incorporated as described in JP-A 2-250050. Furthermore, examples of known adjuvants include those described in RD 17643 (December 1978) page 23–29; Rd 18716 (December 1979) page 648–651; RD 308119 (December 1989) page 996–1009.

Supports usable in photographic materials are described in RD 17643 page 28 and RD 308119 page 1009. Suitable supports include plastic resin films The surface of the support may be provided with a sub-layer or subjected to corona discharge or UV ray exposure to improve adhesive property. Further, a cross-over cut layer or antistatic layer may be provided thereon. Emulsion layer(s) may be provided on one side or both sides of the support. When being provided on both sides, photographic performance may be the same or different in both sides.

EXAMPLES

The present invention will be explained based on examples, but the invention is not limited to these examples.

Example 1

A solid developer composition and a solid fixer composition relating to the invention were each prepared according to the following procedure.

Solid Developer Composition (DA):

(used for developing solution of 10 liters)

The following compounds each pulverized up in a commercially available mill so as to have an average particle size of 10 μm.

| | |
|---|---|
| 1-Phenyl-3 -pyrazolidone | 30 g |
| N-Acetyl-D,L-peniciliamine | 1 g |
| Sodium glutaraldehyde bissulfite | 40 g |
| D-Sorbit | 42 g |
| Sodium 1-octanesulfonate | 5 g |

Developing agent [hydroquinone or Compound of formula (1)] Amount as as shown in Table 1
Compound [sodium sulfite or Compound of formula (2)] Amount as as shown in Table 1
Compound of formula (3) Amount as as shown in Table 1

The mixture was mixed in the mill for 3 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. The granules were further classified by means a dressing machine provided with a 1.0 mm mesh. The thus prepared granules was mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc. to obtain a solid composition (DA) in the form of a tablet in a cylindrical form with a diameter of 30 mm.

Solid Developer Composition (DB):

(used for developing solution of 10 liters)

The following compounds each pulverized up in a commercially available mill so as to have an average particle size of 10 μm.

| | |
|---|---|
| Potassium carbonate | 86 g |
| Diethylenetriaminepentaacetic acid | 17 g |
| Mannit | 170 g |
| D-Sorbit | 50 g |
| Methyl-β-cyclodextrin | 17 g |
| Sodium 1-octanesulfonate | 13 g |
| Compound A | 4 g |
| Compound B | 1 g |

The mixture was mixed in the mill for 3 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. The granules were further classified by means a dressing machine provided with a 1.0 mm mesh. The thus prepared granules was mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc. to obtain a solid composition (DB) in the form of a tablet in a cylindrical form with a diameter of 30 mm.

Compound A

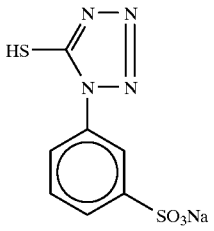

Compound B

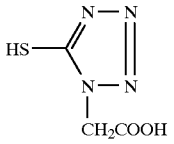

Solid Fixer Composition (FA)

(used for fixing solution of 10 liters)

The following compounds each pulverized up in a commercially available mill so as to have an average particle size of 10 μm.

| | |
|---|---|
| Ammonium thiosulfate | 1220 g |
| Sodium metabisulfite | 95 g |
| Sodium sulfite | 10 g |
| Sodium acetate | 275 g |
| Pineflow | 75 g |
| β-alanine | 125 g |
| Sodium 1-octanesulfonate | 27 g |

The mixture was mixed in the mill for 3 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. The granules were further classified by means a dressing machine provided with a 1.0 mm mesh. The thus prepared granules was mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc. to obtain a solid composition (FA) in the form of a tablet in a cylindrical form with a diameter of 30 mm.

Solid Fixer Composition (FB):

(used for fixing solution of 10 liters)

The following compounds each pulverized up in a commercially available mill so as to have an average particle size of 10 μm.

| | |
|---|---|
| Boric acid | 25 g |
| Succinic acid | 96 g |
| Aluminium sulfate (octahydrate) | 100 g |
| Tartaric acid | 25 g |
| Mannit | 21 g |
| D-Sorbit | 10 g |
| Polyethylene glycol (Av. M. W. 10,000) | 12 g |
| Sodium acetate | 80 g |
| Sodium 1-octanesulfonate | 27 g |

The mixture was mixed in the mill for 3 min. In stirring granulator commercially available, the resulting mixture was granulated for 1 min. at room temperature by adding 30 ml of water. The resulting granules were dried up at 40° C. for 2 hr. in a fluidized bed drier so that the moisture content of the granules was almost completely removed off. The granules were further classified by means a dressing machine provided with a 1.0 mm mesh. The thus prepared granules was mixed for 10 min. by making use of a mixer in a room controlled to be not higher than 25° C. and 40% RH. The mixture was compression-tableted so as to have a filling amount of 10 g per tablet, by making use of a tableting machine that was modified model of Tough Press Collect 1527HU manufactured by Kikusui Mfg. Works, Inc. to obtain a solid composition (FB) in the form with a diameter of 30 mm.

Solid developer compositions (DA) and (DB) were mixed and dissolved in water of 10 liters and the pH of the solution was adjusted to 10.0 with sodium hydroxide to obtain a developing solution. Similarly, solid fixer compositions (FA) and (FB) were mixed and dissolved in water of 10 liters and the pH of the solution was adjusted to 5.4 with sodium hydroxide to obtain a developing solution. Using these processing solutions, preserving property and photographic performance were evaluated.

Preparation of a Silver Halide Photographic Material

Preparation of a seed grain emulsion:

A monodispersed seed grain emulsion (Em-a) was prepared in the following manner.

Solution A1

| | |
|---|---|
| hydrogen peroxide-treated ossein gelatin | 11.3 g |
| Potassium bromide | 6.72 g |
| DF-1 | 1.2 ml |
| Water | 1130 ml |

Solution B1

| | |
|---|---|
| Silver nitrate | 170 g |
| Water | 227.5 ml |

Solution C1

| | |
|---|---|
| Ossein gelatin | 4.56 g |
| potassium bromide | 119 g |
| Water | 227.5 ml |

Solution D1

| | |
|---|---|
| Ammonia water (28%) | 66.6 ml |

DF-1: $HO(CH_2CH_2O)_n—[CH(CH_3)CH_2O]_{17}—(CH_2CH_2O)_m—H$ (m+n=5.7)

To Solution A1 at 40° C. with vigorously stirring were added Solutions B1 and C1 by the double jet addition to form nucleus grains. After completing the addition, the temperature was lowered to 20° C., the silver potential was adjusted to 40 mV, Solution D1 was added thereto in 20 sec., and the resulting emulsion was further ripened for 5 min. Then, 30 g of modified gelatin in which an amino group was substituted by a phenylcarbamoyl group (substitution ratio of 80%), was added thereto, the pH was lowered to 3.0 to allow the emulsion to coagulate and the supernatant was decanted. Thereafter, the pH was again lowered to 3.0 and decantation was repeated. Further, 23 g of ossein gelatin was added to redisperse the seed emulsion. It was proved from electron microscopic observation that the resulting seed emulsion was comprised of monodispersed silver bromide grains having an average grain size of 0.28 μm and a width of distribution of 20%.

Preparation of a Tabular Grain Emulsion:

Using the seed grain emulsion (Em-A) and the following solutions, a silver halide emulsion mainly comprised of tabular twinned crystal grains.

Solution E1

| | |
|---|---|
| Ossein gelatin | 6.49 g |
| DF-1 | 1.2 ml |

Seed emulsion equivalent to 0.62 mol, based on silver

Solution F1

| | |
|---|---|
| Ossein gelatin | 1.69 g |
| Potassium bromide | 113.0 g |
| Potassium iodide | 0.8 g |
| Water | 504 ml |

Solution G1

| | |
|---|---|
| Silver nitrate | 170 g |
| Water | 504 ml |

To Solution E1 at 650° C. with vigorously stirring were added Solutions F1 and G1 by the double jet addition, in which the flow rate was controlled to 80% of the critical rate at which new nucleus grains were produced. During addition, the silver potential was maintained at −10 mV using a KBr aqueous solution. After completing the addition, the pH was adjusted to 6.0 and the emulsion was washed by coagulation process using an aqueous solution of Demol (product by Kao-Atlas) and an aqueous magnesium sulfate solution. Further, 23 g of ossein gelatin was added thereto to redisperse the seed emulsion. The silver potential and pH were adjusted to 50 mV and 5.85, respectively. From electron microscopic observation of about 3,000 grains of the emulsion, it was proved that the resulting emulsion grains had the following characteristics:

Proportion of hexagonal tabular grains of 80%, based the total grain projected area;

Average grain diameter (circular equivalent diameter) of the hexagonal tabular grains of 1.4 μm;

Average grain thickness of the hexagonal tabular grains of 0.4 μm;

Average aspect ratio of the hexagonal tabular grains of 3.5;

Monodispersity of the hexagonal tabular grains of 15%.

Chemical Sensitization of a Tabular Grain Emulsion:

To the emulsion prepared above was added a sensitizing dye([3,3'-di-sulfobutyl-9-ethyl-oxacarbocyanine), 0140 immediately before adding chemical sensitizers of 1% $NH_4SCN$ solution of 5.2 ml, 0.2% $HAuCl_4$ solution of 0.78 ml, 0.25% $Na_2S_2O_3$ of 5.6 ml and 0.4% triphenylphosphine selenide solution of 3.5 ml, each per mol of silver, and chemical sensitization was carried out at 48° C. At 30 min. after starting the chemical sensitization was added 0.002 mol/Ag mol of silver iodide grains with an average size of 0.04 μm and chemical ripening further continued. When the fog density reached 0.02, 300 mg/Ag mol of KBr and 1.4 g/Ag mol of 4-hydroxy-6-methyl-1,3,3a,7-tetraazaindene were added and the temperature was lowered to stop the chemical ripening.

Preparation of Subbed Support

Dispersion of Conductive Particles P1:

Stannic chloride hydrate of 65 g was dissolved in water of 2000 ml and the resulting solution was boiled to obtain a precipitate. The precipitate was takes out by decantation and repeatedly washed with distilled water until a silver nitrate solution was dropwise added to the washing water of the precipitate and no occurrence of chloride ion reaction was confirmed. The precipitate was redispersed in water of 1,000 ml and water was further added to make the total amount of 2,000 ml. A 30% ammonia water of 40 ml was further added thereto and heated in a water bath to obtain a $SnO_2$ sol solution.

When this solution is used as a coating solution, the sol solution was condensed to a concentration of about 8% with bubbling ammonia into the solution. A specific volume resistance of the particles contained in the sol solution was determined in such a manner that the sol solution was coated on a silica glass plate to form a thin layer and the specific volume resistance was measured by the four-terminal method. The measured specific volume resistance was $3.4\times 10^4$ Ω·cm.

Preparation of a Silver Halide Photographic Material Support 1:

Both sides of a polyethylene terephthalate (PET) film blue-tinted at a density of 0.15 and with a thickness of 175 μm after biaxial stretching and thermal fixing, was subjected to corona discharge at 8 W·min/$m^2$, and on one side of the support was coated the following subcoat solution (B-1), as described in JP-A 59-19941 and dried at 100° C. for 1 min. to form a subcoat B-1 having dry thickness of 0.8 μm. On the other side of the support was coated the following subcoat solution (B-2), as described in JP-A 59-77439 and dries at 110° C. for 1 min.

Subcoat solution (B-1)

| | |
|---|---|
| Copolymer latex solution (solid component 30%) comprised of 30 wt. % butyl acrylate, 20 wt. % of t-butylacrylate, 25 wt. % styrene and 25 wt. % of 2-hydroxyethyl-acrylate | 270 g |
| Compound A | 0.6 g |
| Hexamethylene-1,6-bis(ethyleneurea) | 0.8 g |
| Water to make | 1 litter |

Subcoat solution (B-2):

| | |
|---|---|
| Copolymer latex solution (solid component 30%) comprised of 40 wt. % butyl acrylate, 20 wt. % of styrene and 45 wt. % of glycidylacrylate | 23 g |
| Conductive P1 dispersion | 415 g |
| Polyethylene glycol (M. W. 600) | 0.00012 g |
| Water | 568 g |

Both B-1 and B-2 subcoat layers were subjected to corona discharge at 8 W·min./$m^2$ and on each of them was coated the following subcoat solution (B-3) and dried at 100° C. for 1 min. to form a subcoat with a dry thickness of 0.1 μm.

Subcoat solution (B-3):

| | |
|---|---|
| Gelatin | 10 g |
| Compound A | 0.4 g |
| Compound B | 0.1 g |
| Silica particles with av. size of 3 μm | 0.1 g |
| Water to make | 1 litter |

Preparation of Photographic Material:

On both sides of the subcoated PET film base were simultaneously coated the following cross-over cut layer, emulsion layer, and protective layer in this order and dried to prepare a photographic material sample.

1st Layer (Cross-over cut layer)

| | |
|---|---|
| Dye in a solid particle dispersion form (AH) | 50 mg/m$^2$ |
| Gelatin | 0.2 g/m$^2$ |
| Dextrin (Av. M. W. 1,000) | 0.05 g/m$^2$ |
| Dextrin (Av. M. W. 40,000) | 0.05 g/m$^2$ |
| Sodium dodecybenzenesulfonate | 5 mg/m$^2$ |
| 2,4-Dichloro-6-hydroxy-1,3,5-triazine sodium salt | 5 mg/m$^2$ |
| Colloidal silica (Av. size 0.014 μm) | 10 mg/m$^2$ |

2nd Layer (Emulsion layer)

To the chemically ripened emulsion were added the following adjuvants in an amount, based on mol of silver halide.

| | |
|---|---|
| 1-Phenyl-5-mercaptotetrazole | 10 mg/m$^2$ |
| 1-Trimethylolpropane | 14 mg/m$^2$ |
| Compound (C) | 30 mg/m$^2$ |
| t-Butylcatechol | 150 mg/m$^2$ |
| Polyvinyl pyrrolidone (M. W. 10,000) | 850 mg/m$^2$ |
| Styrene-maleic acid copolymer | 2.0 g/m$^2$ |
| Dextrin (Av. M. W. 1,000) | 1.2 g/m$^2$ |
| Dextrin (Av. M. W. 40,000) | 1.2 g/m$^2$ |
| Nitrophenyl-triphenyl-phosphonium chloride | 50 mg/m$^2$ |
| Ammonium 1,3-dihydroxybenzene-4-sulfonate | 1.7 g/m$^2$ |
| 1,1-Dimethylol-1-brom-1-nitromethane | 6.2 mg/m$^2$ |
| n-$C_4H_9OCH_2CH(OH)CH_2N(CH_2COOH)_2$ | 700 mg/m$^2$ |
| Sodium 2-mercaptobenzimidazole-5-sulfonate | 30 mg/m$^2$ |
| Colloidal silica (Rudox AM, product by du'Pont) | 28.5 g/m$^2$ |
| Latex (L) (as solid component) | 28.5 g/m$^2$ |
| Compound (D) | 150 mg/m$^2$ |
| Compound (E) | 30 mg/m$^2$ |
| Compound (F) | 30 mg/m$^2$ |

3rd Layer (Protective layer)

| | |
|---|---|
| Gelatin | 0.8 g/m$^2$ |
| Matting agent, polymethylmetacrylate with an average particle size of 5 μm | 21 mg/m$^2$ |
| Matting agent, polymethylmetacrylate with an average particle size of 3 μm | 28 mg/m$^2$ |
| Hardener ($CH_2$—$CHSO_2CH_2)_2O$ | 36 mg/m$^2$ |
| 2,4-Dichloro-6-hydroxy-1,3,5-triazine sodium salt | 10 mg/m$^2$ |
| Compound (G) | 15 mg/m$^2$ |
| Compound (H) | 5 mg/m$^2$ |
| Compound (I) | 30 mg/m$^2$ |
| Compound (J) | 10 mg/m$^2$ |

The sample had coating amounts of silver and gelatin per one side of 1.3 g/m$^2$ and 2.2 g/m$^2$, respectively. After being aged at 40° C. and 50% RH for a period of 24 hr., the sample was employed for evaluation.

Compound (C)

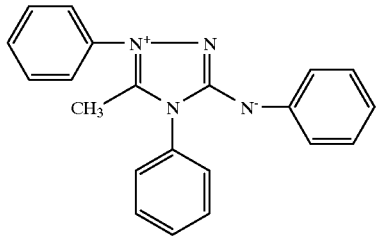

Compound (D)

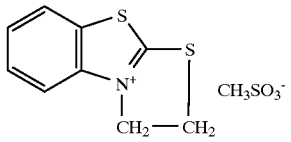

Compound (I)

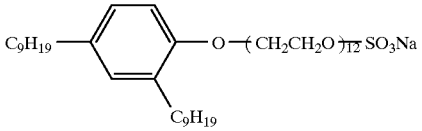

Compound (J)

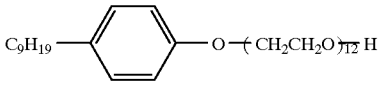

Compound (E)

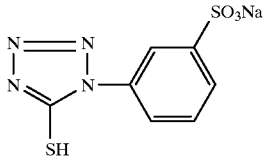

Compound (F)

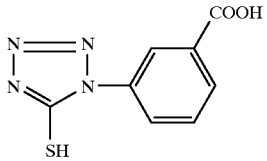

Compound (G)

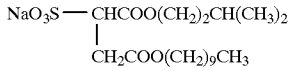

Compound (H)

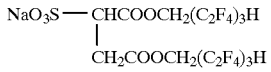

DF-1

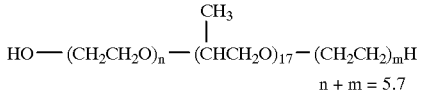

Latex (L)

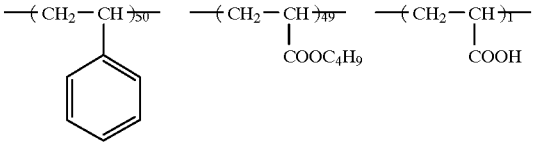

-continued

Dye in a solid particle dispersion (AH)

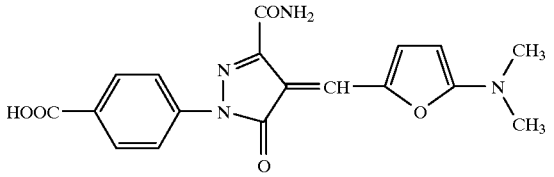

Evaluation of Photographic Performance

The photographic material was processed with the developing and fixing solutions prepared as afore-described, using an automatic processor SRX 701 (available from Konica Corp.) and according to the following conditions.

Processing:

| Step | Temp (° C.) | Time (sec.) | Replenishing |
|---|---|---|---|
| Insertion | — | 0.8 | |
| Developing + Cross-over | 35 | 9.7 | 100 ml/m$^2$ |
| Fixinging + Cross-over | 33 | 5.4 | 100 ml/m$^2$ |
| Washing + Cross-over | 18 | 4.8 | 7.0 l/m$^2$ |
| Squeezing | 40 | 3.8 | |
| Drving | 50 | 5.4 | |
| Total | — | 29.9 | |

The tank volume of the processor was 16 litters of a developing bath, 10 litters of a fixing bath and 10 litters of a washing bath; and 200 g of Clinica 205 (available from Nichiban Res. Lab., mainly comprised of $SiO_2$, $Al_2O_3$ and Ag+ion-ceramics with 1.0–1.5 mm and specific gravity of 2.5–2.6) was filled in a bag of polyethylene fabric cloth with 20 mesh and dipped in the vicinity of the water-supplying portion of the washing bath. In drying was employed an infrared ray heater (a heater temperature of 220° C.) in combination with hot air (60° C.). Insertion of a film was detected with an infrared ray sensor. Detecting the area of 10 sheets of the film (10×12 inch), developing and fixing solutions were each replenished at a rate of 100 ml per 10 sheets of the film.

Sensitometric Evaluation

Using a cassette, the photographic material film was sandwiched between intensifying screens KO-250 (available from Konica Corp.) and exposed, through an aluminum wedge, to X-rays at 80 KvP of a bulb voltage and 100 mA of a bulb current, for 0.05 sec. The sensitivity was defined as a reciprocal of exposure necessary to give a density of fog plus 1.0 and shown as a relative value in Table 1.

Evaluation of Storage Stability of Developing Solutions

Each of the developing solutions of 50 ml was taken out into a test tube with 20 mm in an inner diameter. This test tube was dipped into a thermostat at 35° C. for 8 hr. and thereafter was allowed to stand under an atmosphere at 25° C. for 16 hr. every day.

After 20 days, the content of a developing agent (erythorbic acid or hydroquinone) of the developing solution was determined by the liquid chromatography. Storage stability of the developing solution was evaluated based on a residual ratio of the developing agent. Results thereof are shown in Table 1.

TABLE 1

| Sample No. | Compound (1) (g/l) | Compound (2) (mol/l) | Compound (3) (mol/l) | Storage stability* (%) | Fog | Sensitivity | Remark |
|---|---|---|---|---|---|---|---|
| 1 | HQ (40) | — | — | 60 | 0.03 | 100 | Comp. |
| 2 | 1-1 (50) | — | — | 60 | 0.03 | 110 | Comp. |
| 3 | HQ (40) | SS (0.1) | — | 90 | 0.03 | 80 | Comp. |
| 4 | 1-1 (50) | SS (0.1) | — | 65 | 0.03 | 101 | Comp. |
| 5 | 1-1 (50) | 2-1 (0.01) | — | 80 | 0.03 | 100 | Inv. |
| 6 | 1-1 (50) | 2-1 (0.05) | — | 85 | 0.03 | 100 | Inv. |
| 7 | 1-1 (50) | 2-1 (0.1) | — | 88 | 0.03 | 100 | Inv. |
| 8 | 1-1 (50) | 2-1 (0.5) | — | 90 | 0.03 | 101 | Inv. |
| 9 | 1-1 (50) | 2-2 (0.1) | — | 87 | 0.03 | 100 | Inv. |
| 10 | 1-1 (50) | 2-3 (0.1) | — | 86 | 0.03 | 101 | Inv. |
| 11 | 1-1 (50) | 2-4 (0.1) | — | 89 | 0.03 | 102 | Inv. |
| 12 | 1-1 (50) | 2-8 (0.1) | — | 88 | 0.03 | 101 | Inv. |
| 13 | 1-9 (55) | 2-1 (0.1) | — | 88 | 0.03 | 102 | Inv. |
| 14 | 1-17 (55) | 2-1 (0.1) | — | 87 | 0.03 | 101 | Inv. |
| 15 | 1-1 (50) | 2-1 (0.1) | 3-1 (0.01) | 92 | 0.03 | 101 | Inv. |
| 16 | 1-1 (50) | 2-1 (0.1) | 3-1 (0.05) | 95 | 0.03 | 102 | Inv. |
| 17 | 1-1 (50) | 2-1 (0.1) | 3-1 (0.1) | 97 | 0.03 | 103 | Inv. |
| 18 | 1-1 (50) | 2-1 (0.1) | 3-5 (0.05) | 94 | 0.03 | 101 | Inv. |
| 19 | 1-1 (50) | 2-1 (0.1) | 3-7 (0.05) | 95 | 0.03 | 100 | Inv. |
| 20 | 1-1 (50) | 2-1 (0.1) | 3-9 (0.05) | 94 | 0.03 | 100 | Inv. |
| 21 | 1-1 (50) | — | — | 90 | 0.03 | 70 | Comp.** |

*HQ: hydroquinone, SS: sodium sulfite

**Developing solution employed in Sample No. 21 was prepared in the same manner as that of Sample No. 2, except that the pH was lowered by adding acetic acid to enhance the storage stability.

As can be seen from Table 1, the use of compounds reprersented by formula (2) in combination with reuctones, as a developing agent led to improved storage stability of a developer solution. The use of a compound represented by formula (3) further improved the storage stability.

Example 2

Using each of the developing solutions of Sample No. 2,7,11 and 16, the photographic material of Example 1 was continuously processed in the processor (SRX 701, available from Konica Corp.) at a rate of 7.5 $m^2$/day. The developing tank volume was 16 litters and the developer was replenished at a rate as shown in Table 2. The fixing solution was the same as in Example 1 and its replenishing rate was 100 ml/$m^2$. A starter was the same one as conventionally used in SRX 701. Results are shown in Table 2.

TABLE 2

| Sample No. | Developer No. | Replenishing rate (ml/$m^2$) | Av. residence time (day) | Sensitivity | Remark |
|---|---|---|---|---|---|
| 1 | 2 | 285 | 8 | 95 | Comp. |
| 2 | 2 | 225 | 10 | 85 | Comp. |
| 3 | 2 | 109 | 20 | 70 | Comp. |
| 4 | 2 | 72 | 30 | 50 | Comp. |
| 5 | 7 | 285 | 8 | 99 | Inv. |
| 6 | 7 | 225 | 10 | 98 | Inv. |
| 7 | 7 | 109 | 20 | 96 | Inv. |
| 8 | 7 | 72 | 30 | 94 | Inv. |
| 9 | 11 | 285 | 8 | 99 | Inv. |
| 10 | 11 | 225 | 10 | 97 | Inv. |
| 11 | 11 | 109 | 20 | 95 | Inv. |
| 12 | 11 | 72 | 30 | 94 | Inv. |
| 13 | 16 | 285 | 8 | 99 | Inv. |
| 14 | 16 | 225 | 10 | 98 | Inv. |
| 15 | 16 | 109 | 20 | 96 | Inv. |
| 16 | 16 | 72 | 30 | 94 | Inv. |

In the Table, the sensitivity after 3 months was shown as a relative value, based on the sensitivity at the start being 100.

As can be seen from Table 2, the use of the developer according to the invention led to reduction of the developer replenishing amount per area and stable maintenance of the sensitivity even when an average residence time of the developing solution in the developing bath is extended.

According to the invention, there are provided a processing method of a silver halide light sensitive photographic material and a developer, whereby no lowering of the activity of a developing solution due to aerial oxidation occurs.

What is claimed is:

1. A developer for developing a silver halide photographic light sensitive material comprising a developing agent represented by formula (1) and a compound represented by formula (2):

formula (1)

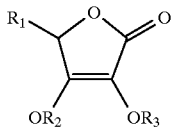

wherein $R_1$ are

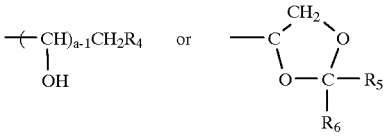

$R_2$ and $R_3$ independently are a hydrogen atom or an alkaline metal atom; in which $R_4$ is a hydrogen atom or hydroxy group, $R_5$ and $R_6$ independently are a hydrogen atom, a halogen atom, an alkyl group, alkenyl group, an aryl group, an alkoxy group, an aryloxy group, an alkylthio group, an arylthio group, an acyl group, an oxycarbonyl group, a carbamoyl group, a carboxy group including its salt, a sulfo group including its salt, or a heterocyclic group, provided that $R_5$ and $R_6$ may combine with each other to form a ring, and a is an integer of 1 to 4;

$M_nHAO_3$ formula (2)

wherein M is a univalent or bivalent atom; when M is univalent, n is 2 and when M is bivalent, n is 1; and A is an atom of the 5B group of the periodic table, except for N.

2. The developer of claim 1, wherein said developer further comprises a compound represented by formula (3) or (4):

formula (3)

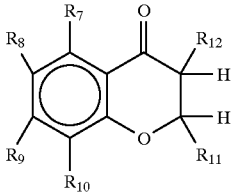

wherein $R_7$, $R_9$, $R_{11}$ and $R_{12}$ are independently a hydrogen atom, a hydroxy group, a carboxy group, an alkyl group, aryl group, an alkoxy group, an aryoxy group and a saccharide residue, provided that all of $R_7$, $R_9$, $R_{11}$ and $R_{12}$ are hydrogen atoms at the same time; $R_8$ and $R_{10}$ are independently a hydrogen atom, a halogen atom, a hydroxy group, a carboxy group, an alkyl group, an aryl group, an alkoxy group, an aryloxy group and a saccharide residue;

formula (4)

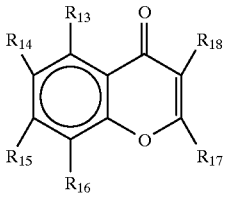

wherein $R_{13}$, $R_{15}$, $R_{17}$ and $R_{18}$ are independently a hydrogen atom, a hydroxy group, a carboxy group, an alkyl group, an aryl group, an alkoxy group, an aryloxy group and a saccharide residue, provided that all of $R_{13}$, $R_{15}$, $R_{17}$ and $R_{18}$ are hydrogen atoms at the same time; $R_{14}$ and $R_{16}$ are independently a hydrogen atom, a halogen atom, a hydroxy group, a carboxy group, an alkyl group, an aryl group, an alkoxy group, an aryloxy group and a saccharide residue.

3. The developer of claim 1, wherein said developer is in the form of an aqueous solution.

4. The developer of claim 1, wherein said developer is in the form of solid.

5. The developer of claim 4, wherein said developer is in the form of granules or a tablet.

* * * * *